United States Patent [19]

Brueck

[11] Patent Number: 4,941,291

[45] Date of Patent: Jul. 17, 1990

[54] DEVICE FOR CENTERING OF OPTIC LENSES IN A MECHANICAL MOUNTING, IN PARTICULAR DURING EDGE CUTTING AND BEVELLING

[75] Inventor: Erhard Brueck, Heuchelheim, Fed. Rep. of Germany

[73] Assignee: Wilhelm Loh Wetzlar Optikmaschinen GmbH & Co. KG, Wetzlar, Fed. Rep. of Germany

[21] Appl. No.: 289,903

[22] Filed: Dec. 23, 1988

[30] Foreign Application Priority Data

Dec. 24, 1987 [DE] Fed. Rep. of Germany ..... 3744116

[51] Int. Cl.[5] ..... B24B 5/04; B24B 9/14; B23B 19/02; B23B 23/04

[52] U.S. Cl. ..... 51/105 L G; 51/162; 51/217 L; 51/217 T; 82/147; 82/151; 82/170; 384/1; 384/118

[58] Field of Search ..... 51/105 L G, 106 L G, 51/162, 217 L, 217 T, 237 R, 277; 82/122, 147, 151, 165, 170, 904; 384/1, 118

[56] References Cited

U.S. PATENT DOCUMENTS

| | | | |
|---|---|---|---|
| 2,508,009 | 5/1950 | Bonin | 51/217 T |
| 2,660,484 | 11/1953 | Gerard et al. | 384/118 |
| 2,663,977 | 12/1953 | Gerard et al. | 82/147 |
| 3,143,382 | 8/1964 | Ertaud et al. | 384/118 |
| 3,359,045 | 12/1967 | Hsu | 384/1 |
| 3,599,377 | 8/1971 | Dartnell | 51/277 |
| 3,750,344 | 8/1973 | Raphael | 51/105 L G |
| 4,434,581 | 3/1984 | Spriggs | 51/67 |
| 4,612,736 | 9/1986 | Massard et al. | 51/105 L G |
| 4,809,466 | 3/1989 | Junker | 51/217 T |

FOREIGN PATENT DOCUMENTS

| | | | |
|---|---|---|---|
| 1004516 | 8/1957 | Fed. Rep. of Germany . | |
| 2148102 | 11/1978 | Fed. Rep. of Germany . | |
| 3139873 | 4/1983 | Fed. Rep. of Germany . | |
| 231269 | 11/1968 | U.S.S.R. | 384/1 |

*Primary Examiner*—William Terrell

*Attorney, Agent, or Firm*—Flynn, Thiel, Boutell & Tanis

[57] ABSTRACT

For centering optic lenses in a mechanical mounting, in particular during edge cutting and bevelling, a device with a housing (10) is provided, in which housing a split drive shaft (14, 14') with a torque divider (50) is supported. Two centering spindles (18, 18') are aligned in an axial direction (A) and are in this manner driven by a motor. The ends of the mutually adjacent ends of the centering spindles carry clamping cups (20, 20') between which a lens (L) can be aligned and clamped. An air bearing is provided at least for the lower clamping spindle. The air bearing can be pressure loaded by paraxial and/or graduated-ring-shaped channels (90) with control openings (A, B). In particular, two diametrically opposed air-cushion fields can be loaded with pressure. The clamping spindle (18) can then be smoothly axially moved by a membrane piston (32) permitting thereby a very finely dosable feed movement (FIG. 3).

10 Claims, 4 Drawing Sheets

A
16'
82'
74a
90'
90'
22'
78
80
VIBRATOR
C
76
100'
10
90'
90'
18'
19'
74b
20'
L
α
20

20'
α
20
L
18
84b
19
90
100
10
Ai
Ai
98
88
22
86
Bi
Bi
90
84a
82
16
34
24
26
32
A

Fig. 4
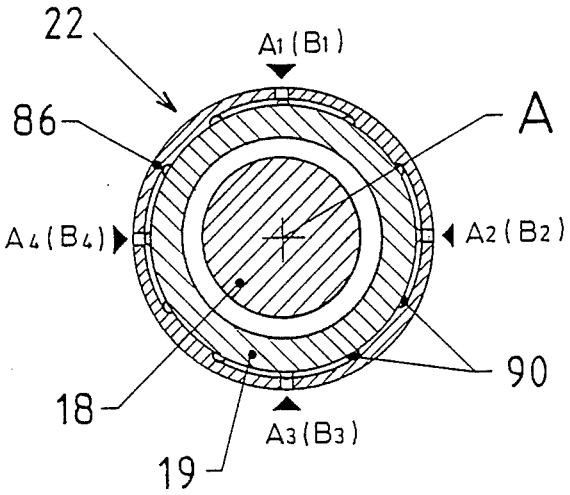
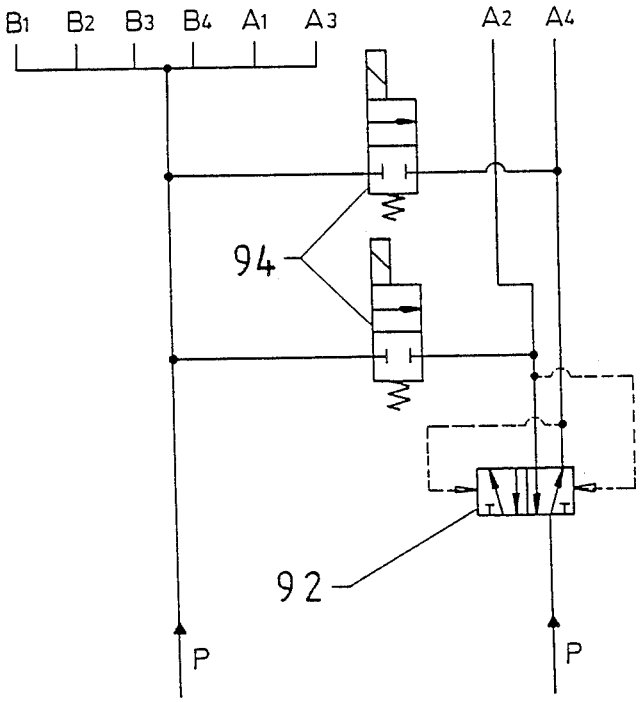
Fig. 5

DEVICE FOR CENTERING OF OPTIC LENSES IN A MECHANICAL MOUNTING, IN PARTICULAR DURING EDGE CUTTING AND BEVELLING

CROSS REFERENCE TO RELATED APPLICATIONS

This application is related to my three copending applications filed concurrently herewith, each application having the same title, but separately identified as Attorney's Docket (1) Missling Case 212, (2) Missling Case 213 and (3) Missling Case 214.

FIELD OF THE INVENTION

The present invention relates to a device for centering optic lenses in a mechanical mounting, in particular during edge cutting and bevelling of the lens.

BACKGROUND OF THE INVENTION

According to German Patent No. 1 004 516, the lens is for this purpose clamped at high pressure between two cups, so that its position cannot change by itself. To center the lens, the clamping cups are vibrated by ultrasound during the clamping operation in order to convert the static friction between cup and lens into a lower sliding friction. However, this transition occurred sporadically, which often caused damage to the lens due to an undesired material removal.

Furthermore, an attempt has been made to drive the clamping cups during clamping of the lens in opposite directions of rotation Here too a high risk exists that lens damage will occur, that is, cutting tracks in the form of rings cut into the surface of the lens can hardly be avoided.

German Auslegeschrift No. 21 48 102 suggests to arrange a piezoceramic case vibrator on the elevationally nonchangeable clamping cup, which case vibrator is electrically controlled by a threshold switch such that the clamping cup force drops off when reaching a given pressure, which causes the vibration generator to be turned off. The piezovibrator is used at the same time to test the clamping pressure, to which the vibrational amplitude is regulated. Electronic instabilities are disadvantageous in this arrangement. Furthermore, the vibrator has a not insignificant sensitivity with respect to axial pressure. An initial stress is created during clamping due to the pressure load; a supporting of the vibrator is therefore problematic.

From German Offenlegungsschrift No. 31 39 873 a device is known in which the irregularities of a gear drive are utilized to produce relative movements between lens and clamping cup. A balanced differential is provided as a compensating device between the two parts of a two-part centering spindle and the drive shaft. A hydraulic clamping cylinder is provided for a pressure plate of the upper, axially movable spindle. Due to the high friction of the clamping spindle in its slide bearing, a precise regulating of the clamping pressure is, however, difficult to realize, so that this device can also only be utilized in a limited way.

The purpose of the invention is, while overcoming the disadvantages of the state of the art, to improve the centering of the bearing support and clamping of optic lenses in an economical way such that the adjustments for the cutting operation and the cutting operation itself can be carried out in a short period of time, easily and precisely with the least possible pressure load on the lens. By providing, at least for the lower centering spindle, a guide bearing loadable with air, the invention achieves in an extremely simple manner a transition to a sliding friction during an axial movement of the centering spindle, the frictional forces being thereby reduced to approximately one tenth of the static friction forces. The very smoothly responding arrangement makes it possible for the entire centering operation to occur during a phase where light contact with the lens exists.

It is also possible to provide an air bearing for the upper centering spindle.

Each air bearing has a thin guide sleeve which snugly encloses the respective centering spindle or rather its outer sleeve and itself is surrounded by a pressure-loadable cavity. This arrangement is structurally simple and permits one to adjust and/or regulate the clamping pressure as needed in order to clamp spindles for the machining task.

The clamping bearings are arranged aligned in closed chambers of the housing. The housing is, due to a honeycomb-shaped construction having a generally C-shaped design, resistant to twisting, so that the clamping bearings maintain their alignment even during a high load.

The pressure can in the upper clamping bearing be adjustable or resettable by means of an adjusting device. At least for the lower clamping bearing there is provided, a connection to the pressure-medium supply with a controllable or adjustable pressure. The desired pressure relationships can in this manner be created clearly and precisely.

An important further development of the invention, consists in the oppositely lying air bearings being reciprocally loadable with a higher and lower pressure. The frequency and pressure of the air load can thereby be regulatable or rather adjustable pneumatically and/or electrically. The clamping spindle is thus vibrated in its air bearing by placing two oppositely arranged air cushions reciprocally under increased pressure. The vibrations can be produced in a conventional manner by a vibrator. The clamping cup and the lens is also moved translatorically by the translatoric vibration introduced through the air cushion on the clamping spindle. Since the lens is not fixedly connected to the clamping cup and rests on it only by its own weight, small sliding movements between the lens and clamping cup are created by its mass moment of inertia. This changes the static friction to a sliding friction and thus the friction coefficient is also reduced. If the moving lens during alignment touches the upper clamping cup, the aligning forces are also significantly reduced by the reduced friction coefficient. The minimum clamping angle of 16° fixed by the static friction can thus be substantially reduced and the area of the self-centering lens can be enlarged. The air bearings can be especially designed so that the inner wall or rather each guide sleeve has channels and/or pockets, in particular in the form of four separate air-cushion fields. A further specialization provides that the channels or rather pockets are constructed as axially parallel and/or partial-ring-shaped grooves. The very simple construction guarantees a precise guiding with the least possible friction during a loading with pressurized air, which is also advantageous during the cutting operation in order to keep cooling and lubricating means and abrasive material away from the spindle bearing

BRIEF DESCRIPTION OF THE DRAWINGS

Further characteristics, details and advantages of the invention result from the wording of the claims and from the following description of one exemplary embodiment in connection with the drawings, in which:

FIG. 4 is a further enlarged cross-sectional view corresponding with the plane Ai—Ai of FIG. 3, and FIG. 5 is a schematic illustration of the pressure medium control for the arrangement according to FIGS. 3 and 4.

DETAILED DESCRIPTION

Figure 1:
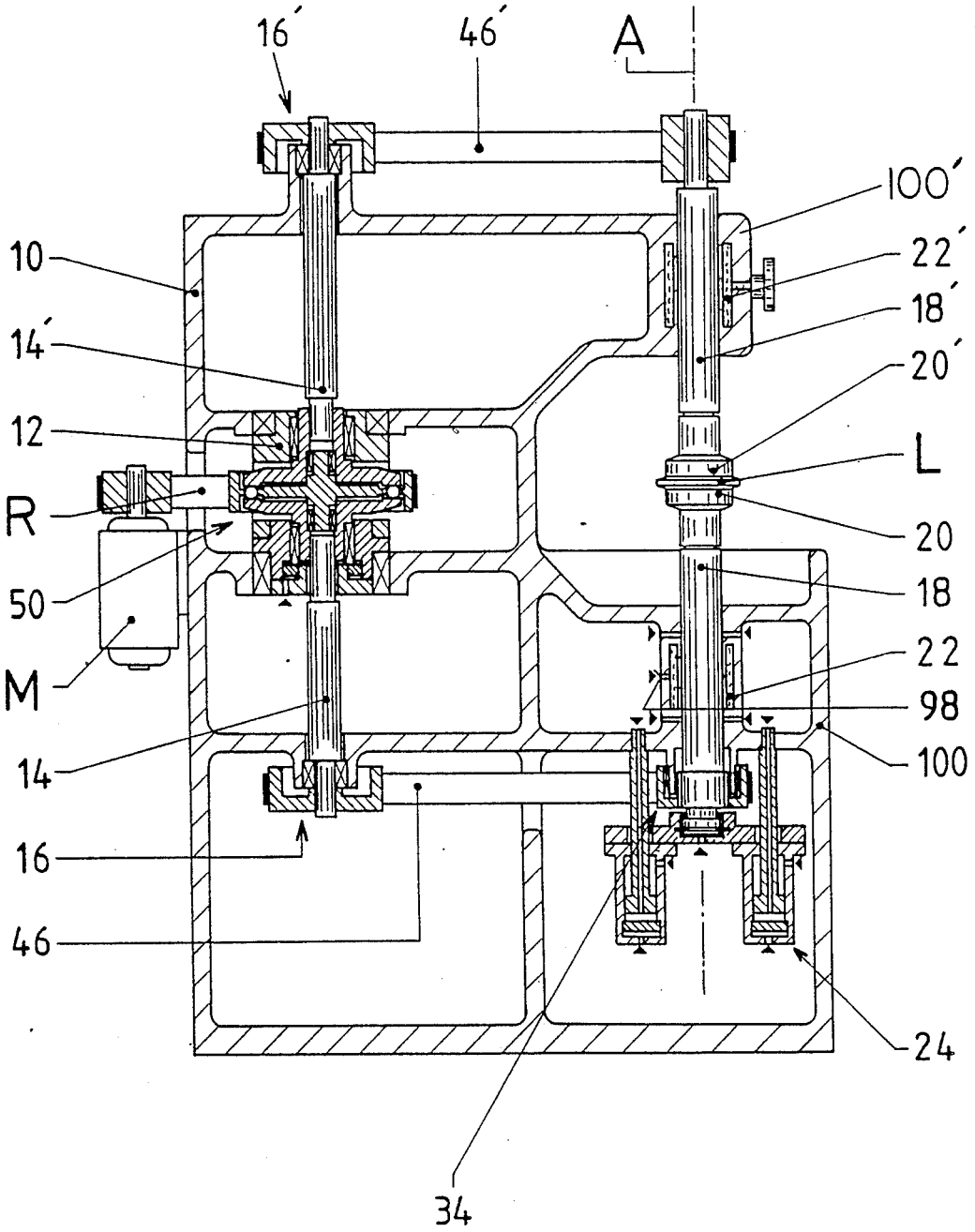
FIG. 1 is a complete axial cross-sectional view of a centering device.

The device shown in FIG. 1 has a housing 10 which includes a bearing 12 for drive shafts 14, 14' which act on centering spindles 18, 18' through drive elements 16, 16', which centering spindles 18, 18' are aligned with one another in an axial direction A. They carry clamping cups 20, 20' at their free ends, between which clamping cups 20, 20' a lens can be aligned and clamped.

A motor M synchronously drives through a belt drive R and a torque divider 50 the two drive shafts 14, 14'. The drive elements 16 act on a coupling piece 34 at the lower end of the lower centering spindle 18, which is also called the clamping spindle. It can be fed in the axial direction A by means of a clamping device 24 in order to align and mechanically hold a lens L during the cutting operation.

The clamping device 24 has a crossbar 26 in the form of a plate, in which crossbar 26 is centrally arranged a membrane piston 32 for the support of the lower end of the clamping spindle 18. The clamping device 24 is in the lower projecting part 100 of the housing 10, which part also has a guide bearing 22 for the clamping spindle 18. A clamping bearing 22' for the upper centering spindle 18', which is also identified as a fixed spindle, is arranged in a projecting arm 100' of the housing.

Figure 2:
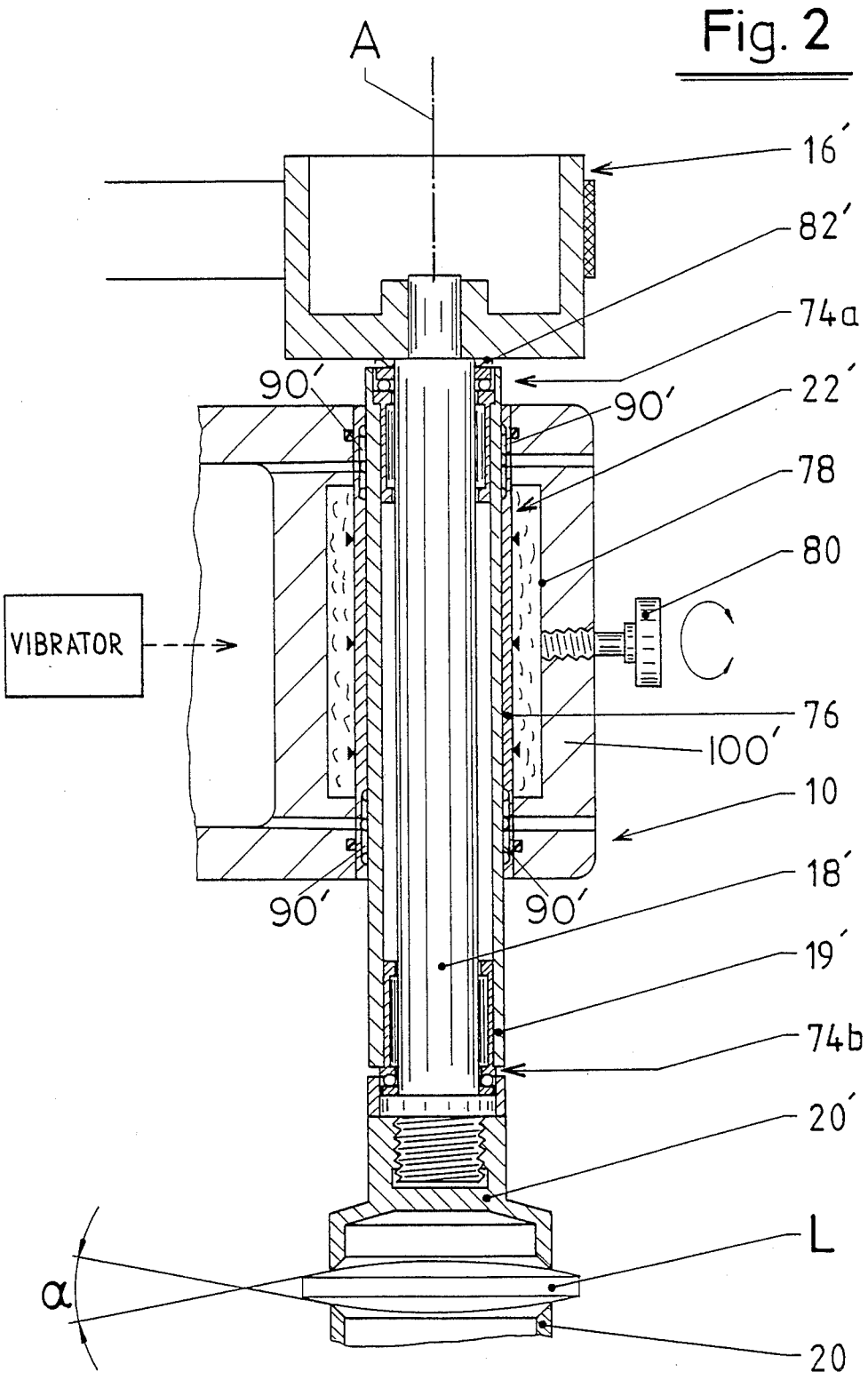
FIG. 2 is an enlarged axial cross-sectional view of an upper centering spindle bearing.

This arrangement can particularly be seen in FIG. 2. One recognizes that the clamping bearing 22' has in the support part 100' of the housing 10 a cavity 78 which surrounds a sleeve 76, which sleeve rests concentrically on the fixed spindle 18' or rather its guide sleeve 19'. The sleeve 76 and cavity 78 define an annular pressure chamber radially therebetween. The pressure in the cavity 78 can be reduced or increased selectively by means of an adjusting screw 80 which functions as a piston. By releasing (loosening) the adjusting screw 80 it is possible to adjust as needed the elevational position of the centering spindle 18' during a setting of the machine. The upper centering spindle 18' is then fixed in its elevational position by tightening the adjusting screw 80. Thus, the upper clamping cup 20' is elevationally nonchangeably fixed.

Figure 3:
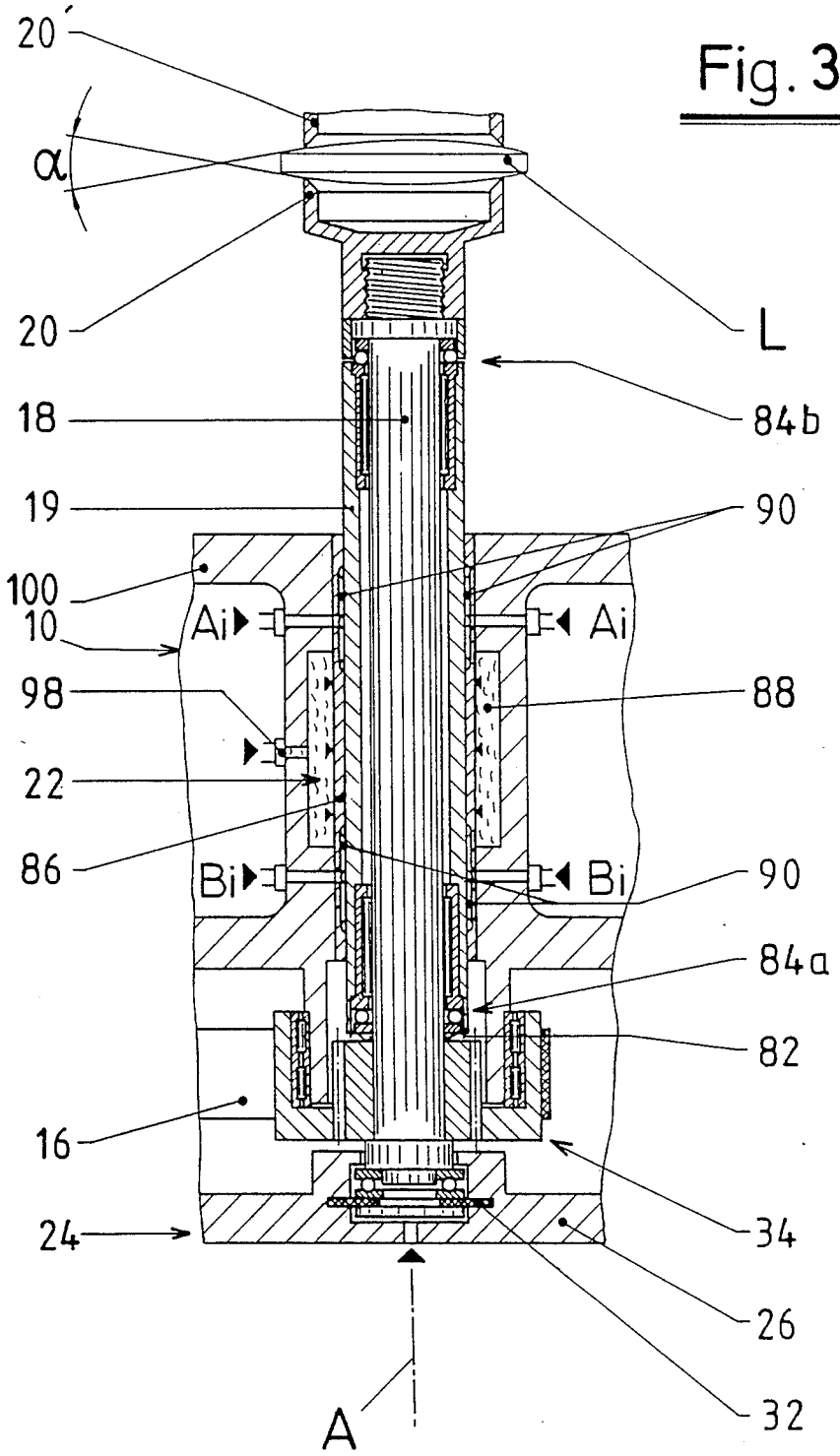
FIG. 3 is an enlarged axial cross-sectional view of a lower centering spindle bearing.

The feeding of the lens L, which lens rests on the lower clamping cup 20, is now done by an upward movement of the lower centering spindle 18. Its air bearing can be seen in FIG. 3. The air bearing is arranged in the lower support part 100 of the housing 10 above the clamping device 24. The air bearing has a sleeve 86 which snugly surrounds the clamping spindle 18 or its guide sleeve 19.

Channels 90 are provided at the ends of the sleeve 86, which channels 90 are preferably arranged axially parallel and/or partial-ring-shaped in order to form in particular diametrically opposed air-cushion fields. The fields can be loaded or vented with pressure air through control openings A and B (FIG. 3), preferably reciprocally with a pneumatically or electrically controlled vibrator (See FIG. 2). The vibrations in the air bearing can be adjusted and optimized as needed by a frequency and pressure regulation. The smooth axial movement of the centering spindle 18 is then effected by the pressure load on the membrane piston 32 of the clamping device 24. Air bearings 90' may similarly be provided in the support part 100' for the centering spindle 18' (FIG. 2).

A clamping bearing 22 is used to tighten the clamping spindle 18, which clamping bearing 22 is formed by the sleeve 86 and a cavity 88 surrounding the sleeve 86. The cavity 88 is connected to a pressure-medium supply pipeline through a connection 98. Upon an increase of the pressure in the cavity 88, the sleeve evenly deforms all around and clamps the clamping spindle exactly axially aligned.

The centering spindles 18, 18' can be one piece. Preferred, however, is the embodiment according to FIGS. 2 and 3, according to which the fixed spindle 18' has a guide sleeve 19', which is supported axially and radially with respect to the inner, actual rotating spindle 18' by support bearings **74*a*, 74*b*. Corresponding support bearings 84*a*, 84*b* are provided for an outer sleeve 19 which surrounds the inner actual clamping spindle 18. The two centering spindles are in a clamped state axially movable for a small distance caused by spring washers 82, 82'**, so that the required clamping pressure can be adjusted.

All characteristics and advantages, which can be taken from the claims, the description and the drawings, including structural details, spacial arrangements and method steps, can be inventively important both by themselves and also in many different combinations.

The embodiments of the invention in which an exclusive property or privilege is claimed are defined as follows:

1. A device for centering optic lenses in a mechanical mounting for edge cutting and bevelling, comprising:

a housing, and means for defining at least one air bearing in said housing;

a pair of coaxially aligned guide sleeves supported in said housing, at least one said guide sleeve being radially adjustably supported in said housing by said air bearing, and support bearings provided in said guide sleeves;

a pair of coaxially aligned centering spindles rotatably and axially slidably supported on said support bearings in respective said guide sleeves, each said centering spindle having a pair of axial ends, one said end of one said centering spindle being adjacent one said end of the other said centering spindle, said adjacent ends carrying clamping cups thereon for clamping a lens therebetween;

a drive mechanism for rotating said centering spindles; and clamping means for moving one said centering spindle and the associated said clamping cup axially toward the other said centering spindle and associated said clamping cup.

2. The device according to claim 1, wherein said at least one air bearing includes a further guide sleeve supported in said housing and snugly surrounding said at least one guide sleeve, said further guide sleeve being radially thinner than said first-mentioned guide sleeves, and wherein said housing includes means for defining therein at least one cavity, said at least one cavity surrounding said further guide sleeve of said at least one air bearing such that said cavity defining means and said further guide sleeve define an annular pressure chamber radially therebetween, means for loading said pressure chamber with pressurized fluid, said pressure chamber and said pressurized fluid forming a clamping bearing in said housing for clamping said at least one guide sleeve to prevent axial movement of the associated said centering spindle.

3. The apparatus according to claim 2, wherein said at least one air bearing includes said further guide sleeve having means for defining grooved channels in a radially inner surface thereof, said channel defining means and said at least one guide sleeve defining pockets radially therebetween, said pockets containing pressurized fluid.

4. The device according to claim 3, wherein both of said first mentioned guide sleeves are radially adjustably supported by respective said air bearings in said housing, each said air bearing having a respective said clamping bearing associated therewith.

5. The device according to claim 4, wherein said housing includes means for adjusting the pressure of said pressurized fluid in one of said pressure chambers.

6. The device according to claim 4, wherein said housing includes means for connecting at least one of said clamping bearings to a source of said pressurized fluid.

7. The device according to claim 4, wherein said pockets of said air bearings are located substantially diametrically opposite one another, and wherein said housing includes means for adjusting the pressure of said pressurized fluid in respective said pockets independently of one another.

8. The device according to claim 7, wherein said means for adjusting the fluid pressure in said pockets includes vibrator means.

9. The device according to claim 4, wherein each said air bearing includes four of said pockets, and wherein said pockets are one of axially extending and circumferentially extending, relative to said further guide sleeves.

10. The device according to claim 9, wherein said housing is generally C-shaped, having a main body and a pair of spaced support parts which project therefrom, each said support part having a respective one of said clamping bearings, said air bearings, said first-mentioned guide sleeves, and said centering spindles arranged therein, said clamping bearings being axially aligned with one another in respective said support parts of said housing.

* * * * *